US006026617A

United States Patent [19]

Stark

[11] Patent Number: 6,026,617

[45] Date of Patent: Feb. 22, 2000

[54] JAMB LINER FOR FLAT-SIDED TILT-TYPE WINDOW SASH AND WINDOW ASSEMBLY THEREWITH

[75] Inventor: Ivan L. Stark, Ada, Mich.

[73] Assignee: Newell Industrial Corporation, Roanoke, Va.

[21] Appl. No.: 08/919,715

[22] Filed: Aug. 28, 1997

[51] Int. Cl.[7] ..... E06B 3/964

[52] U.S. Cl. ..... 52/204.66; 52/204.5; 52/204.51; 49/181; 49/176; 49/184

[58] Field of Search ..... 49/181, 183, 184, 49/161, 176, 179; 52/204.5, 204.51, 204.62, 204.66

[56] References Cited

U.S. PATENT DOCUMENTS

| | | | |
|---|---|---|---|
| 3,789,549 | 2/1974 | Yip | 49/181 |
| 4,363,190 | 12/1982 | Anderson | 49/181 |
| 4,570,382 | 2/1986 | Suess . | |
| 4,887,389 | 12/1989 | Haltof . | |
| 5,033,235 | 7/1991 | Stark . | |
| 5,036,622 | 8/1991 | Stark . | |
| 5,117,586 | 6/1992 | Stark . | |
| 5,174,064 | 12/1992 | Stark . | |
| 5,243,783 | 9/1993 | Schmidt et al. | 49/181 |
| 5,371,971 | 12/1994 | Prete | 49/380 |
| 5,383,303 | 1/1995 | Nakanishi et al. | 49/181 |
| 5,526,608 | 6/1996 | Stark . | |
| 5,566,507 | 10/1996 | Schmidt et al. | 49/428 |
| 5,632,118 | 5/1997 | Stark . | |
| 5,669,180 | 9/1997 | Maier | 49/181 |

*Primary Examiner*—Christopher T. Kent
*Assistant Examiner*—Yvonne Horton-Richardson
*Attorney, Agent, or Firm*—Price, Heneveld, Cooper, DeWitt & Litton

[57] ABSTRACT

A window assembly of the type having at least one sash which is slidably mounted between a pair of jambs defining a window case, wherein the sash includes jamb-engaging side members (i.e., stiles) which have generally flat edges. The flat or flush sides of the sash stiles allow the sash to be easily pivoted away from the plane of the window case, without pushing on, or deforming, the jamb liners, thus overcoming problems generally associated with conventional sash having recess or plows configured to be interfitted with protruding ridge-like channels projecting outwardly from the jambs, as is typically the case with wood-frame windows. In accordance with another aspect of the invention, weatherstrips are mounted to each of the jamb liners to provide weathersealing engagement between the jamb liners and the sash stiles at the sides of the windows. The weatherstrips provide an improved weatherseal as compared with known windows wherein weatherstripping is not provided between the window sash and jamb liner, including windows of the type having stile plows and interfitting jamb ridges. Also, by attaching the weatherstripping to the jambs, as opposed to the sash, the extreme difficulty associated with reliably and cost-effectively anchoring a weatherstrip onto the stiles of a wood-type sash is avoided. Another aspect of the invention provides a spring cover for completely concealing a tension spring used to balance the weight of a vertically movable sash.

18 Claims, 2 Drawing Sheets

JAMB LINER FOR FLAT-SIDED TILT-TYPE WINDOW SASH AND WINDOW ASSEMBLY THEREWITH

FIELD OF THE INVENTION

This invention relates to windows of the type having at least one sash which is slidably mounted between a pair of jambs defining a window case, and more particularly to a window having at least one sash which is both slidably mounted between the jambs of the window case and which can be pivoted or tilted away from the plane of the window, such as for cleaning.

BACKGROUND OF THE INVENTION

Windows having a wooden sash which is slidably mounted between the jambs of a window case generally include "plows" or vertical grooves on the opposing sides of the stiles thereof which are configured to closely receive interfitting channels or other such ridges which protrude from the adjacent jamb liners. The interfitting relationship between the ridges on the jamb liners and the plows on the sides of the stiles facilitates proper tracking of the window sash between the jambs as the sash is raised and lowered, provides frictional engagement between the windows and the jamb liners, or engagement with frictional positioners located in the channels, to help retain the sash at selected raised positions, and provides some weathersealing between the jambs or jamb liners and the sides of the stiles.

Although the interfitting structural relationship between the plows on the sides of wood or other such window sash and the ridges or channels on the jamb liners provides certain advantages, this also tends to interfere substantially with the ability to pivot the sash out of the window case, such as for cleaning, and also interferes with the ability to remove the sash, such as to repair the sash. More specifically, it is typically necessary to push on the jamb liner laterally, or else deform the jamb liner, in order to disengage the plow and channel and pivot the sash out of the plane in which the sash is vertically slidable.

Accordingly, a window of the type having at least one sash slidably mounted between jambs of a window case, which is configured to eliminate the need for conventional plows and interfitting jamb channels or other ridges to achieve easy pivoting of the sash from the plane of the window and yet will adequately perform the functions of the typical plows and jamb ridges would be a significant improvement over the existing state of the art. Another benefit associated with elimination of the plow and interfitting jamb protrusions is that it would be easier and less expensive to make a wood sash without plows, because this would eliminate a routing operation on each of the stiles.

Known windows having a wooden sash slidably mounted between opposing jambs of a window case often do not include any weatherstripping. Instead, a sort of weatherseal is provided by the interfitting relationship between the plows and the jamb liner ridges, together with similar such structure along the edges of the sash stiles and the recessed channels in which they are sometimes slidably disposed. This weathersealing function of the plow and jamb ridges is not always satisfactory on account of small gaps which can develop between the plows and the ridges either during manufacture or during use. Such gaps can provide passageways for air to pass through. The sash of certain types of vinyl windows have been known to include a weatherstrip which engages the jamb to provide a weatherseal. However, it has not been practical or recognized as being desirable to provide a wooden sash with a weatherstrip, because of the difficulty which would be associated with anchoring a weatherstrip to the stiles of a wooden sash, and because of the convention of relying on the weathersealing action between the jamb ridges and plows of wooden sash.

As will be appreciated, it would be desirable to provide an improved weatherseal between the jambs and stiles of a wooden sash, and an alternative, improved weatherseal between the jambs and the wooden sash would be particularly desirable if the traditional sash plows and interfitting jamb ridges could be eliminated.

In windows having a sash which is slidably mounted for vertical movement between the jambs of a window case, it is generally desirable to employ a tension spring and friction device to support the sash at various raised positions. The purpose of the tension spring is to urge the sash upwardly with a force which approximately balances the weight of the sash. The friction device is generally in the form of an elongate friction shoe which rides in a vertical channel or the like. The friction shoe has surfaces which frictionally engage the walls of the vertical channel or guide. The magnitude of the frictional engagement forces between the frictional shoe and the vertical guide is generally intended to be about the minimum necessary to overcome any imbalance between the weight of the sash and the force of the tension spring, to retain the sash at any desired raised position while nonetheless allowing for easy sliding movement. An undesirable aspect of using a tension spring to balance the weight of the sash is that the spring is usually disposed such that it is visible along each side of the jamb. While some effort has been made previously to conceal or protectively cover the tension spring, the resulting concealment has been incomplete and/or not aesthetically satisfactory.

Accordingly, there remains a need for an aesthetically acceptable tension spring concealment device which completely conceals the tension spring irrespective of the position of a sash in the window.

SUMMARY OF THE PRESENT INVENTION

The invention provides a window having a sash which is mounted for vertical movement between opposing jambs of a window case which overcomes the disadvantages of traditional wood or wood-type windows having stiles with relatively deep plows configured to interfit with ridges projecting from the jambs, which overcomes disadvantages associated with conventional windows which either do not include weatherstripping or which include weather-stripping attached to the sash, and which overcomes disadvantages associated with windows having spring balance means which are not concealed in an aesthetically acceptable manner.

In one aspect of the invention, problems associated with windows having sash with plows configured to be interfitted to ridges projecting from the jambs of a window case are overcome by a window assembly including opposing jamb liners and a sash which is mounted for vertical movement between the jamb liners, the sash including jamb liner-engaging sides which are flat. The flat or flush sides of the stiles allow the sash to be easily pivoted away from the plane of the window case, without pushing on, or deforming, the jamb liners.

In another aspect of the invention, problems associated with windows having a sash slidably mounted between jambs of a window case, wherein the spaces between the sides of the sash and the jambs are not provided with weatherstripping or are provided with weatherstripping attached to the sash, are overcome. More specifically, a window assembly is provided which includes opposing jamb liners, a sash mounted for vertical sliding movement between said jamb liners, the sash having vertical stiles, and a weatherstrip mounted to each of the jamb liners to provide weathersealing engagement between the jambs and the stiles. The weatherstrip provides an improved weatherseal between the jamb liners and the stiles as compared with known windows wherein weatherstripping is not provided, such as windows of the type having stile plows and interfitting jamb ridges. Also, by attaching the weatherstripping to the jamb liners, as opposed to the sash, the difficulty associated with anchoring a weatherstrip to the stiles of a wooden sash is avoided.

In accordance with a further aspect of the invention, a window assembly including jamb liners, a sash mounted for vertical sliding movement between the jamb liners, a tension spring connected at one end to a window case and connected at another end to the sash or to a friction shoe or other member supporting the sash, is further provided with a spring cover for completely concealing the tension spring, irrespective of the position of a sash mounted in the window, in an aesthetically acceptable manner.

These and other features, objects and advantages of the present invention will become apparent upon reading the following description thereof together with reference to the accompanying drawings.

DETAILED DESCRIPTION OF THE PREFERRED EMBODIMENT

Figure 1:
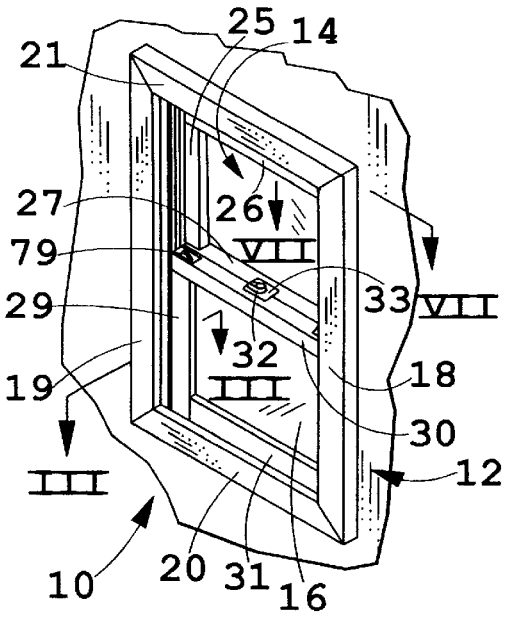
FIG. 1 is a perspective view of a window assembly in accordance with the invention.
Figure 2A:
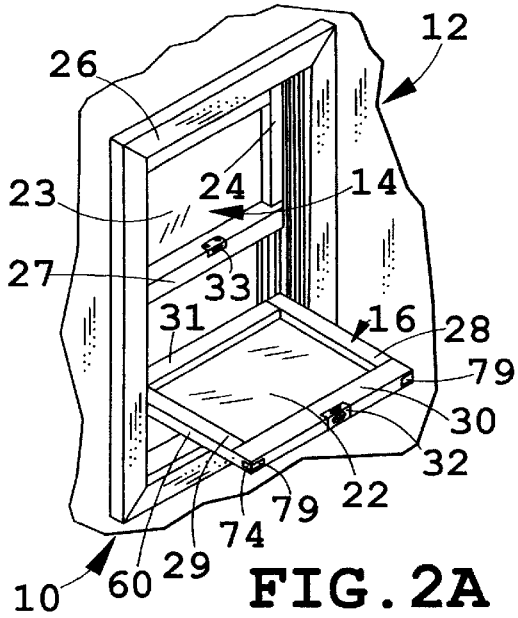
FIG. 2A is a perspective view of the window shown in FIG. 1, with a lower sash tilted out of the plane of the window case.
Figure 2B:
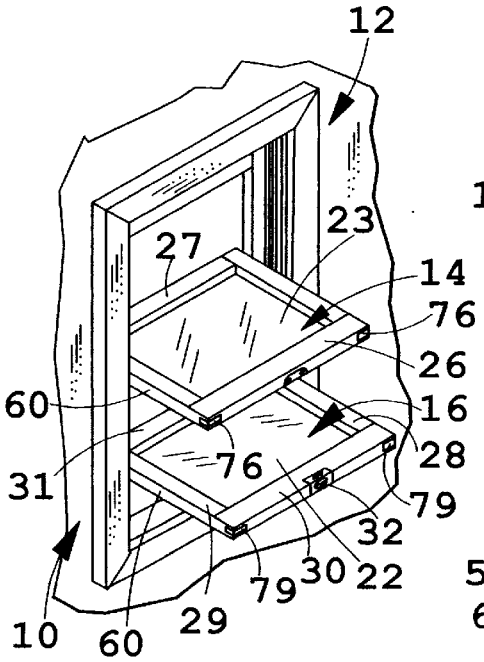
FIG. 2B is a perspective view of the window in FIG. 1, with both the upper and lower sash tilted out of the plane of the window case.

Shown in FIG. 1 is a window 10 including a window case or frame 12 in which an upper sash 14 and lower sash 16 are slidably mounted for vertical movement in a plane generally defined by the window case 12. The window case 12 is defined by vertical members or jambs 18 and 19 and by horizontal members 20 and 21. As shown in FIG. 2A, at least the lower sash 16 is mounted in the window case 12 so that it may be pivoted out of the plane of the window, such as for cleaning the glass or other such glazing panel 22 mounted within sash 16. More preferably, as shown in FIG. 2B, both upper and lower sash 14 and 16 are mounted in window case 12 so that they can be pivoted out of the vertical plane generally defined by window case 12, such as to allow for cleaning of the outer sides of glazing panels 22 and 23 mounted in sash 14 and 16, respectively. Upper sash 14 is generally defined by vertical members or stiles 24 and 25, and by upper and lower horizontal rail members 26 and 27, respectively. Stiles 24 and 25 and horizontal rail members 26 and 27 together frame glazing panel 23. Likewise, glazing panel 22 of lower sash 16 is framed by stiles 28 and 29, and horizontal rail members 30 and 31. Upper horizontal member 30 of lower sash 16 is provided with a latch 32 configured to engage a catch 33 mounted on lower horizontal member 27 of upper sash 14 to lock upper and lower sash 14 and 16 in a closed position as shown in FIG. 1. The members comprising the sash can be made of various suitable materials, including wood.

Figure 3:
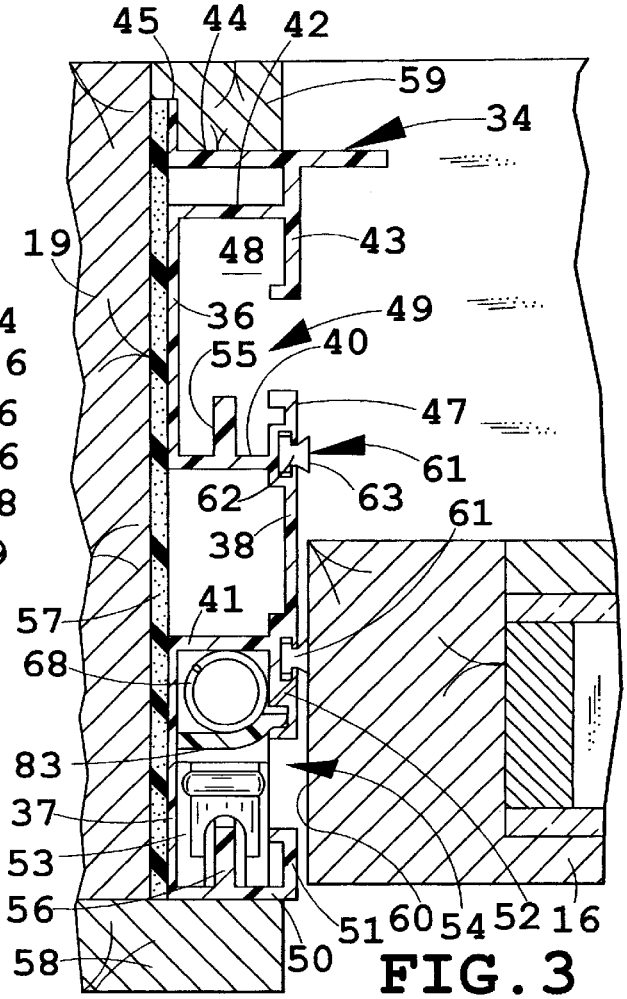
FIG. 3 is a cross-sectional view taken along the plane III—III of FIG. 1.
Figure 7:
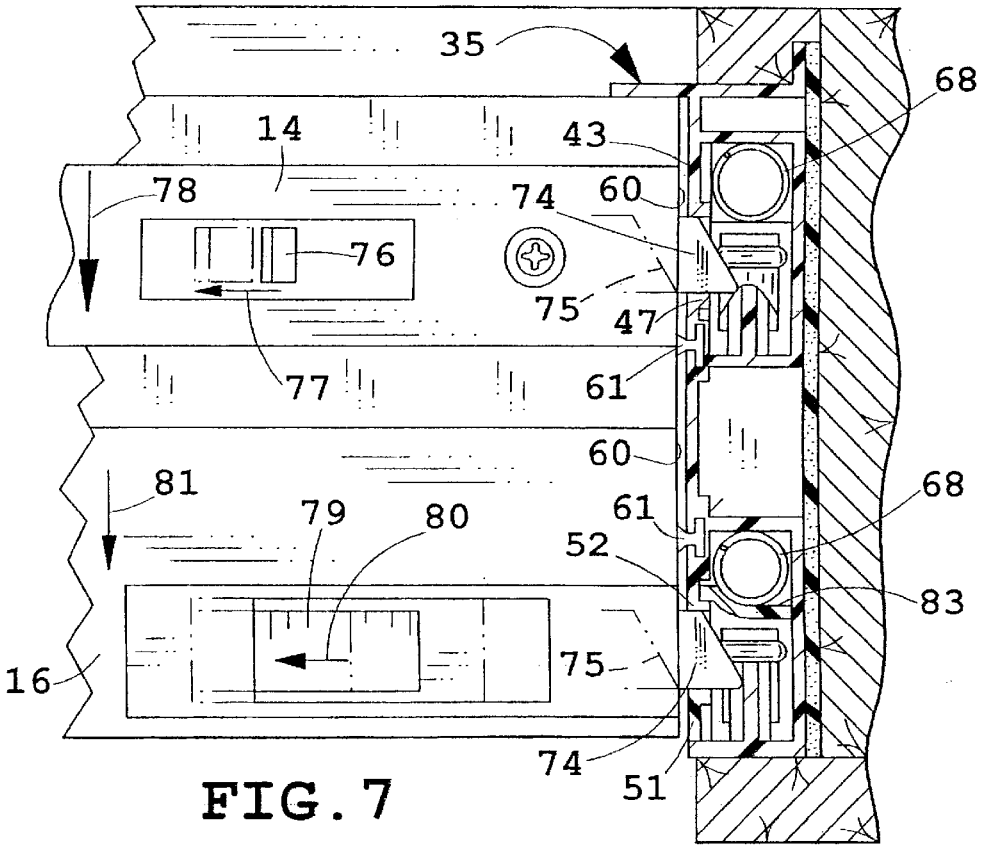
FIG. 7 is a fragmentary top plan view in partial cross section taken along the plane VII—VII of FIG. 1.

Secured to each of the jambs 18 and 19 are jamb liners 34 and 35, which are shown in FIGS. 3 and 7, respectively. Each of the jamb liners is an elongated extruded member which extends along the height of the jambs between the horizontal members 20 and 21, the jamb liners being mounted on the side of jambs 18 and 19 which face toward each other and toward the sash 14 and 16. Jamb liners 34 and 35 are mirror images of one another. Accordingly, jamb liner 34, shown in FIG. 3, will be described in detail, it being understood that the description of jamb liner 34 applies equally to jamb liner 35. Jamb liner 34 includes jamb-engaging rear walls 36 and 37 which are laterally spaced apart, a central, sash-engaging front wall 38, and transverse walls 40 and 41 which connect rear wall 36 and rear wall 37 to front wall 38. Rear walls 36 and 37 are generally aligned in the same plane, and transverse walls 40 and 41 space front wall 38 from rear walls 36 and 37 in a plane which is generally parallel to that of the rear walls. Also projecting into the window space from rear wall 36 is a transverse wall 42 which is connected to an outside front wall 43 which is aligned in the same plane as front wall 38. An outside end wall 44 extends rearwardly from outside front wall 43 toward jamb 19. Extending outwardly at a right angle from end wall 44 is a rear wall flange 45 which is aligned in the plane defined by rear walls 36 and 37. Extending forwardly from outside front wall 43 into the window opening is an outside abutment wall 46. Front wall extension 47, rear wall 36, transverse walls 40 and 42, and outside front wall 43 together define a vertical guideway 48 having a vertically elongate slot 49 defined by spaced apart front wall 43 and front wall extension 47. Extending forwardly from rear wall 37 toward the window opening is a transverse end wall 50, and extending outwardly from the forward end of end wall 50 is an inside front wall 51 which extends in the plane defined by front walls 38 and 43. Extending inwardly from and in the same plane as that of front wall 38 is front wall extension 52. Together, rear wall 37, transverse wall 41, end wall 50, inside front wall 51, and front wall extension 52 define a vertical guideway 53 having a vertically elongate slot 54 defined by the spacing between inside front wall 51 and front wall extension 52. Vertical guideways 48 and 53, which are substantially identical, each include a friction shoe engagement wall 55 and 56, respectively, which project outwardly from side wall 40 and inside end wall 50, respectively, and extend in a plane substantially parallel to and intermediate between the planes defined by rear walls 36 and 37, and front walls 38, 43 and inside front 51. The jamb liners 34 and 35 can be made of any of a variety of materials, but are preferably made of extruded plastic, such as polyvinyl chloride.

A cushion or compressible pad 57 is disposed between jamb 19 and jamb liner 34 (and between jamb 18 and jamb liner 35). Cushion pad 57 is preferably a relatively thin, resiliently compressible material, such as a foamed plastic material exhibiting elastomeric properties, such as a foamed polyurethane material. Cushion pad 57 resiliently urges jamb liners 34 and 35 against the sides of sash 14 and 16 to ensure contact therebetween and compensate for minor dimensional variations along the length of either the stiles or the jambs. Cushion pad 57 can be secured to jambs 18 and 19 using any of various suitable fastening means, such as adhesives, screws, nails, staples, and the like, but more conventionally is secured to the jamb liners 34 and 35 using any of such fasteners. Securement of the jamb liners to the jambs is aided by inner and outer jamb trim pieces 58 and 59 which engage inside and outside end walls 50 and 44, respectively. Rear wall flange 45 and the outer edge of cushion pad 57 are preferably wedged within a recessed area defined by a cutout section in outer jamb trim piece 59.

As illustrated in FIGS. 2A, 2B, 3, and 7, the side edges 60 of stiles 24, 25, 28, and 29 of sash 14 and 16 have flat or planar surfaces which are smooth and free of recesses, grooves or protuberances. The flat sides of the stiles minimize interengagement between the sash and the jamb liner, allowing the sash to be easily pivoted out of the plane of the window. Thus, the flat sides of the sash facilitate tilting and removal of the windows for cleaning of the outer surfaces of the glazing panels 22 and 23, or other parts of the window assembly which are not normally accessible from the inside.

Figure 4:
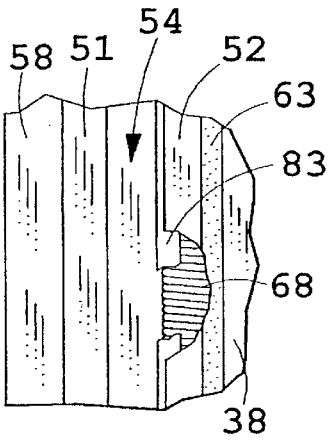
FIG. 4 is fragmentary side elevational view of a jamb liner of the window shown in FIGS. 1, 2, and 3.

Because the sash 14 and 16 do not include the customary plows or vertical grooves along their sides which are engaged by ridges protruding from the jamb liner, improved, alternative weathersealing means are provided. Specifically, the jamb liners 34 and 35 are provided with a weatherstrip 61, as shown in FIGS. 3, 4, and 7. Weatherstrip 61 includes a T-shaped base portion 62 and a pile portion 63 which achieves weathersealing engagement between the sash 14 and 16 and the jamb liners 34 and 35. Jamb liners 34 and 35 are preferably provided with T-shaped recesses which are configured to receive the T-shaped base portion of weatherstrip 61. In particular, weatherstrip 61 is secured to jamb liners 34 and 35 by sliding the T-shaped base portion of the weatherstrip into the T-shaped recess or groove provided in the jamb liners with the pile portion 63 projecting outwardly to engage the sash, so that the weatherstrip is physically held by the jamb liners. However, any of various suitable alternative weatherstripping can also be utilized with corresponding means for attaching the weatherstrips to the jamb liners.

Figure 5:
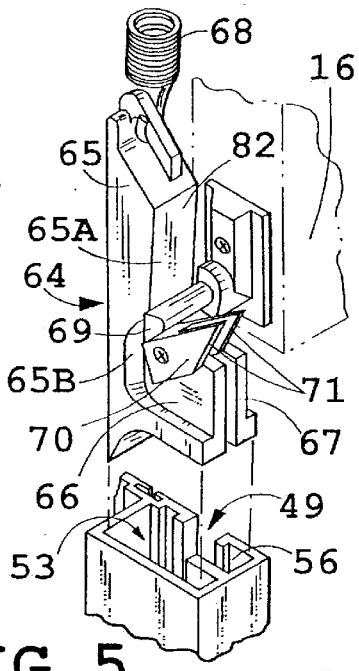
FIG. 5 is a fragmentary view of a spring balance and friction shoe assembly used to balance the weight of a sash and retain it in a desired raised position in the window shown in FIGS. 1, 2, and 3.
Figure 6:
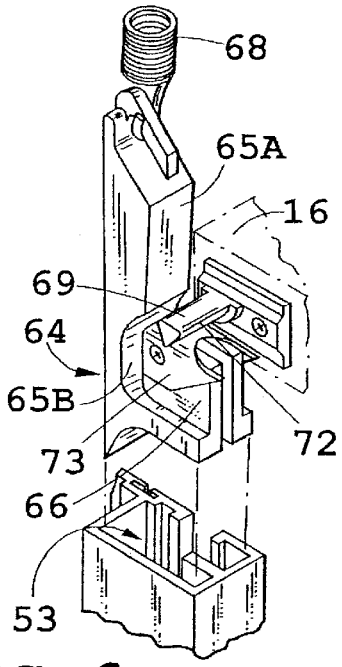
FIG. 6 is a fragmentary view of the spring balance and friction shoe assembly shown in FIG. 5, with the sash pivoted out of the plane of the window.

In FIGS. 5 and 6 there is shown a shoe 64 which is configured to be freely but closely received within vertical guide 53. The lower portion of shoe 64 has a generally rectangular horizontal cross section, complementary to that of guideway 53 into which it fits. The clearance or gap between the inner walls of the guide 53 and the outside surfaces of shoe 64 are, on average, large enough to allow the shoe to freely slide vertically within the guide 53, but sufficiently small to prevent the orientation of the shoe 64 with respect to the guide 53 from varying to any significant extent. As shown in FIGS. 5 and 6, shoe 64 has an L-shape and includes a vertically elongate portion 65 having a vertically angled inner face 65A, together with a pair of laterally aligned, parallel, and mutually spaced engagement walls 66 and 67 which project outwardly from a generally arcuate recess 65B disposed below the vertically angled surface 65A of shoe 64. The spacing between walls 66 and 67 of shoe 64 is sufficient to allow the interior jamb liner wall 56 to be slidably disposed therebetween. Shoe 64 can be made of any of a variety of suitable materials, particularly plastic, nylon being preferred.

Spring 68 is connected at its lower end to shoe 64 (FIGS. 5 and 6), and at its upper end to the jamb liner 34. Sash 16 includes a pivot pin 69 of generally triangular or wedge-shaped cross section which projects from a lower portion of each stile through slot 49 and into a respective one of the guides 48 and 53, where it engages and is supported by the shoe 64 disposed within the guides, as described further below.

As shown in FIGS. 5 and 6, shoe 64 includes a braking element 70 which is pivotally connected to the walls 66 and 67 at a point near the arcuate recess 65B. Braking element 70 includes first and second prongs 71 which engage end wall 50 of jamb liners 34 and 35 when sash 16 is pivoted out of the plane of the window and into that shown in FIG. 6. Pin 69 has a wedge-shaped cross section with a side disposed adjacent the top of braking element to act as a camming surface which comes into flush engagement with the upper side of braking element 70 when sash 16 is pivoted out of the plane of the window, causing braking element 70 to pivot from the position shown in FIG. 5, wherein the prongs 71 are spaced away from wall 50, toward the position shown in FIG. 6, wherein the prongs engage and slightly embed themselves into wall 50 of jamb liners 34 and 35. This engagement securely holds shoes 64 in place as sash 16 is pivoted out of the plane of the window, thus preventing the lower end of the sash from being moved vertically by spring 68 as the window is pivoted and its weight is increasingly removed from the shoe 64. Braking element 70 is preferably made of a hard, durable material, such as steel or other metal or alloy.

Because the sides of sash 14 and 16 are flat, i.e., do not include a plow which is engaged by a ridge projecting from the jamb or jamb liner, sash 14 and 16 are provided with guide-engagement members 74 (FIG. 7) which project laterally from an upper portion of each of the stiles into a respective one of the guides 48 and 54 through the vertically elongate slots 49 and 54, respectively. As shown in FIG. 7, guide-engagement members 74 engage the edges of wall 51 and wall extension 52 defining slot 54, and wall 43 and extension 47 defining slot 49, thereby preventing tilting of sash 14 and 16 away from the plane of the window as sash 14 or 16 are raised or lowered within the plane of the window. The close engagement between guide-engagement members 74 and the portions of jamb liners 34 and 35 defining slots 49 and 54 ensure smooth tracking of the sash as they are being raised or lowered.

In order to allow the sash 14 and 16 to be pivoted out of the plane of the window, guide-engagement members 74 are retractably mounted into the sash, as indicated in phantom outline in FIG. 7 by reference numeral 75. Sash 14 is pivoted out of the plane of the window by shifting slide lever 76 in the direction indicated by arrow 77 and rotating the upper end of the sash in the direction generally indicated by arrow 78. Likewise, sash 16 is pivoted out of the plane of the window by shifting slide lever 79 in the direction indicated by arrow 80 and rotating the upper end of sash 16 in the direction generally indicated by arrow 81.

Pivot pin 69 is not fixed to shoe 64, but instead merely rests upon the latter. When the sash is disposed generally in the plane of the window, as shown in FIG. 5, the pointed edge of wedge-shaped pin 69 is disposed at the bottom of a V-shaped notch area generally defined by the angled upright wall of recess 65B and the top of braking element 70, in which position it is held by the weight of the window. When the sash is rotated out of the plane of the window, the side of pin 69 closest to brake element 70 is rotated into flush contact with the latter to pivot it toward the position shown in FIG. 6. As that occurs, pin 69 continues to rotate and this brings a second angular edge thereof into contact with the top of brake element 70 at a point spaced from that shown in FIG. 5, as shown in FIG. 6, located on the opposite side of the pivot which secures braking element 70 to walls 66 and 67. This applies a greater force to braking element 70, assuming that its prongs 71 will forcefully contact, and preferably embed into, the wall 50. When that occurs, the shoe 64 is locked in place within the jamb liner and one side of the sash can be raised upwardly to lift the pin 69 on that side of the sash away from its associated shoe 64 and out of the guide 53 defined by jamb liner 34 or 35, freeing that side of the window from the jamb liner. Of course, the shoe on the opposite side of the sash has also been locked in place by the same chain of events, and after the first side of the tilted window has been lifted in the manner just stated the other pin 69 can be easily withdrawn from the other shoe and jamb liner by moving the window laterally away from the jamb liner on that side.

Referring to FIGS. 3 and 7, a spring cover 83 is preferably installed within an upper portion of guideways 53 associated with the inner (lower) sash 16. More specifically, the vertical edges of spring cover 83 are positioned within slots defined in jamb liner rear wall 37 and front wall extension 52 to define an enclosed area within the guideway wherein the spring 68 is disposed and concealed from view. The spring cover 83 generally extends from the top end of guideway 53 to a height which is at or just below the upper edge of sash 16 when sash 16 is lowered to the position shown in FIG. 1. Thus, spring 68 is completely concealed irrespective of the position of sash 16. Spring cover 83 is preferably made of any suitable flexible material which will allow the spring cover to be snapped into position as shown in FIG. 3 or slid downwardly into the jamb liner from the top prior to installation. Suitable materials include flexible polyvinyl chloride, such as those having a durometer of about 70.

Having described the preferred embodiment of the invention, it will be recognized that modifications and other embodiments may be possible without departing from the principles of the invention. Such modifications and embodiments are to be considered as included in the appended claims, unless these claims, by their language, expressly state otherwise.

The invention claimed is:

1. A window assembly comprising:

a window case including opposing jambs;

first and second sash mounted within the window case, at least a first of the sash being vertically movable in a plane generally defined by the jambs and being tiltable out of said plane, the first sash including opposing stiles with sides engaging the jambs, each of the jambs including a jamb liner defining a vertical guideway;

said window assembly further comprising a shoe slidably disposed within each of the guideways for vertical movement therein, a spring disposed within each of the guideways, each of the springs being fixed at an upper end and connected at a lower end thereof to a respective one of said shoes, a pivot pin projecting laterally outward from a lower portion of each stile of the first sash into a respective one of the guideways and supported by the shoe disposed therein; and a guide-engagement member projecting outwardly of and beyond an upper portion of at least one stile of the first sash into a respective one of the guideways, engagement between said guide-engagement members and the guideway retaining the upper portion of said first sash within the vertical plane of the window.

2. The window assembly of claim 1, wherein the guide-engagement members are retractable from the guideways to allow the first sash to be pivoted about said pivot pins and tilted out of the plane generally defined by the jambs.

3. The window assembly of claim 2, wherein the pivot pins rest within a generally V-shaped notch which is defined by an upright wall of the shoe and the upper side of a braking element pivotally attached to the shoe.

4. The window assembly of claim 1, further comprising a spring cover mounted within an upper portion of each of the guideways associated with the first sash, the spring cover and guideway defining an enclosure in which the spring is disposed and concealed from view, the spring cover generally extending from an upper end of the guideway downwardly to a height equal to or below the upper end of the first sash when it is in its fully lowered position.

5. The window assembly of claim 4, wherein the spring cover is flexible.

6. The window assembly of claim 1, further comprising a weatherstrip mounted to each jamb liner, the weatherstrip extending vertically along the length of each jam liner on the side thereof adjacent said sash stile and positioned for engagement with the flat sides of the stiles of the first sash to establish a weatherseal between the jamb liners and the sash.

7. The window assembly of claim 6, wherein the weatherstrips include a generally T-shaped base portion and a pile portion, and wherein the jambs are provided with a T-shaped groove for receiving the weatherstrip therein.

8. A window assembly comprising:

a window case including opposing jambs, each of the jambs including a jamb liner defining a vertical guideway;

a shoe slidably disposed within each of the guideways for vertical movement therein;

first and second sash mounted within the window case, at least a first of the sash being vertically movable in a plane generally defined by the jambs, the first sash including opposing stiles with sides engaging the jambs;

a spring disposed within each of the guideways, each of the springs being fixed at an upper end thereof and connected at a lower end thereof to a respective one of the shoes, the first sash being supportably mounted on the shoes; and a spring cover mounted within an upper portion of each of the guideways associated with the first sash, the spring cover and guideway defining an enclosure in which the spring is disposed and concealed from view, the spring cover generally extending from an upper end of the guideway downwardly to a height generally the same as or below the upper end of the first sash when it is in its fully lowered position.

9. The window assembly of claim 8, wherein the spring cover is flexible.

10. The window assembly of claim 9, wherein the spring cover is made of polyvinyl chloride having a durometer of about 70.

11. The window assembly of claim 8, wherein the first sash includes opposing stiles with sides engaging the jamb liners, the jamb-engaging sides of the stiles being substantially flat.

12. The window assembly of claim 11, further comprising a weatherstrip mounted to the jamb liner, the weatherstrip extending vertically along the length of the jamb liner and being positioned for engagement with the substantially flat sides of the stiles of the first sash to establish a weatherseal between the jamb liner and the sash.

13. The window assembly of claim 11, wherein the weatherstrip includes a generally T-shaped base portion and a pile portion, and wherein the jamb is provided with a T-shaped groove for securely receiving the weatherstrip therein.

14. A window assembly comprising:

a window case including opposing jambs, each of the jambs including a jamb liner;

first and second sash mounted within the window case, at least the first of the sash being vertically movable in a plane generally defined by the jambs, the first sash including opposing stiles with sides engaging the jambs; and a weatherstrip mounted to each jamb liner, the weatherstrip extending vertically along the length of each of said jamb liners on the side thereof adjacent said stiles of said first sash and being positioned for engagement with the sides of the stiles of the first sash to establish a weatherseal between the jamb liners and the sash, said weatherstrips including a generally T-shaped base portion and a pile portion, and said jambs having a T-shaped groove for securely receiving at least said base portion of the weatherstrips therein.

15. The window assembly of claim 14, wherein the jamb-engaging sides of the stiles are substantially flat.

16. The window assembly of claim 14, wherein the first sash comprises wooden stiles.

17. A window assembly comprising:

a window case including opposing jambs, each of the jambs including a jamb liner;

first and second sash mounted within the window case, at least the first of the sash being vertically movable in a plane generally defined by the jambs, the first sash including opposing stiles with sides engaging the jambs; and a weatherstrip mounted to each jamb liner, the weatherstrip extending vertically along the length of each of said jamb liners on the side thereof adjacent said stiles of said first sash and being positioned for engagement with the sides of the stiles of the first sash to establish a weatherseal between the jamb liners and the sash; wherein each of the jamb liners defines a vertical guideway and further comprises a positioning shoe slidably disposed within each of the guideways for vertical movement therein, a spring disposed within each of the guideways, each of the springs being fixed at an upper end thereof and connected at a lower end thereof to a respective one of the positioning shoes;

a pivot pin projecting from a lower portion of each of the stiles of the first sash into a respective one of the guideways and resting upon the shoe disposed therein, and a guide-engagement member projecting from an upper portion of each stile of the first sash into a respective one of the guideways, engagement between the guide-engagement members and the guideway holding the first sash within the vertical plane of the window; and a spring cover mounted within an upper portion of each of the guideways associated with the first sash, the spring cover and guideway defining an enclosure in which the spring is disposed and concealed from view, the spring cover generally extending from an upper end of the guideway downwardly to a height equal to or below the upper end of the first sash when it is in its fully lowered position.

18. The window assembly of claim 17, wherein the guide-engagement members are retractable from the guideways to allow the first sash to be pivoted about the pins out of the plane generally defined by the jambs.

* * * * *